US006409372B1

(12) United States Patent
Peters et al.

(10) Patent No.: US 6,409,372 B1
(45) **Date of Patent: *Jun. 25, 2002**

(54) CAPPED ELECTRIC LAMP

(75) Inventors: Ralph Hubert Peters, Maastricht; Hendrikus Albertus Maria Van Dulmen; Wilhelmus Johannes Maria Manders, both of Eindhoven, all of (NL)

(73) Assignee: Koninklijke Philips Electronics N.V. (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/583,029

(22) Filed: May 30, 2000

(30) Foreign Application Priority Data

Jun. 1, 1999 (EP) ..... 99201732

(51) Int. Cl.[7] ..... F21V 7/04

(52) U.S. Cl. ..... 362/549; 362/226; 362/263; 362/267; 362/296; 313/318.01; 313/318.11

(58) Field of Search ..... 362/226, 263, 362/267, 296, 549; 313/318.01, 318.11

(56) References Cited

U.S. PATENT DOCUMENTS

| | | | | |
|---|---|---|---|---|
| 5,775,933 A | * | 7/1998 | Chen | 439/419 |
| 5,952,773 A | * | 9/1999 | Manders et al. | 313/318.01 |
| 6,210,020 B1 | * | 4/2001 | Van Dulman et al. | 362/226 |

FOREIGN PATENT DOCUMENTS

| | | | |
|---|---|---|---|
| DE | 1034268 | 7/1958 | |
| EP | 0618609 A1 | 10/1994 | H01K/1/46 |
| WO | WO9952128 | 10/1999 | H01K/1/46 |

* cited by examiner

*Primary Examiner*—Stephen Husar
*Assistant Examiner*—Guiyoung Lee
(74) *Attorney, Agent, or Firm*—Dicran Halajian

(57) ABSTRACT

An electric lamp includes a light-transmitting lamp vessel which is closed in a gastight manner. An electric element is arranged in the lamp vessel and is connected to current conductors which issue from the lamp vessel to the exterior. A lamp cap is connected to the lamp vessel. The lamp cap has a housing which includes a coupler formed as an integral whole with the housing. The coupler and the housing share an integral, resilient intermediate portion.

28 Claims, 3 Drawing Sheets

CAPPED ELECTRIC LAMP

FIELD OF THE INVENTION

The invention relates to a capped electric lamp provided with:

a light-transmitting lamp vessel which is closed in a gastight manner, which has an axis, and in which an electric element is arranged having a center and connected to current conductors which issue from the lamp vessel to the exterior;

a lamp cap connected to the lamp vessel, which lamp cap comprises a housing;

said housing being provided with:

contact members which are connected to the current conductors;

at least a reference means;

at least a locking means for locking the connection between the lamp vessel and the lamp cap; and at least a coupling means.

BACKGROUND OF THE INVENTION

Such a capped electric lamp is known from EP-A-0 618 609. The known lamp is provided with a pressure body to which the lamp vessel is coupled. The pressure body is coupled to the housing by means of a snap connection, said housing having a circumferential wall extending parallel to the axis. A separate elastic body, for example a rubber disc or ring, is accommodated between the pressure body and the housing, as seen in axial direction. A permanent force obtains between the housing and the pressure body owing to the elasticity of the disc or ring, so that the pressure body with the lamp vessel connected thereto remains correctly positioned with respect to the housing. A number of functional units of the lamp cap such as contact members, reference means, and coupling means, are present axially displaced relative to one another. This means that the lamp has a comparatively great constructional height in axial direction.

The known lamp is suitable for being mounted in a reflector. The lamp has a projecting collar which is provided with studs which co-operate with the reflector and by means of which the lamp cap and the reflector are coupled to one another in a rotary movement. The known lamp is highly suitable for use as a vehicle headlamp.

Car set makers require that the actions to be performed in the assembly of car components, for example lighting units for vehicles, are as simple as possible. A further wish is that the car components should be universally applicable and uniform, i.e. independent of the assembling method, such as in the case of lamps, for example, the plate, front, and back mounting methods. The known lamp should accordingly be designed for any mounting method as desired, bulb forward (back/plate mounting) or lamp cap forward (front mounting) against a support. The lamp is then held by additional means on the support, such that the electric element occupies a predetermined position with respect to this support.

A disadvantage of the known capped lamp is that it is not universally applicable owing to the comparatively large and highly asymmetrical lamp cap, for example that it is unsuitable for front mounting. A second disadvantage is the cumbersome assembly of the lamp and the lighting unit, on the one hand owing to the comparatively large number of loose components and on the other hand on account of the comparatively complicated rotary movements necessary for coupling the lamp cap to the reflector. A third disadvantage is that tolerances in the dimensions of the housing and the pressure body are compensated for by the elastic ring to a limited degree only. This means that there is a considerable risk that the housing and the pressure body bear upon one another without a permanent spring pressure, so that the housing and the pressure body can become displaced relative to one another, with the result that the electric element will no longer be correctly aligned with respect to the support.

A capped electric lamp is known from DE-B-1 034 268 where the glass bulb of the lamp is closed off by a plate of insulating material, which plate lies in a plane which is at least substantially perpendicular to the axis. A hollow cylindrical lamp cap is fixed at the side of the plate facing away from the bulb in a manner not described in any detail. The known bulb, however, is only designed for back and plate mounting. It is desirable for various applications, however, to have a lamp available which can be placed against a support with its lamp cap forward.

SUMMARY OF THE INVENTION

It is an object of the invention to provide a capped electric lamp of the kind described in the opening paragraph which is of a simple, easily manufactured construction and which counteracts the above disadvantages.

According to the invention, this object is achieved in that the coupling means forms an integral whole with the housing in that they share an integral, resilient intermediate portion. Since the lamp cap does not comprise loose components but is made from one piece, it has the advantage of a simple lamp assembly and at the same time renders possible a more compact lamp with smaller constructional dimensions. In the mounted state, the resilient intermediate portion is in a non-relaxed state, so that there is a permanent spring pressure between the coupling means and the reference means. The reference means and the coupling means thus remain in a fixed position relative to one another in the mounted state. The lamp is universally applicable because the compact lamp cap is comparatively small compared with the lamp vessel. A difference in stiffness of the resilient action of the resilient intermediate portion can be realized in a simple manner by means of thickness variations and the choice of material for the resilient intermediate portion. It is thus easy to realize a desired value of the permanent resilient force exerted between the lamp cap and a support coupled thereto, for example a reflector or an adapter, via the reference means, which is formed, for example, by studs or surfaces. It was found that a force equal to twice the force of gravity is sufficient for keeping the lamp positioned under normal practical conditions involving shock and impact loads.

In an embodiment, the lamp is characterized in that the resilient intermediate portion is displaceable around the housing in a substantially axial direction. The axial displaceability of the resilient intermediate portion around the housing may be achieved, for example, in that the resilient intermediate portion is provided with an internal dimension which, seen in one and the same plane, is greater than an external diameter of the housing. It is advantageously achieved thereby that the shape of the lamp cap is self-releasing from its mold. The mold can accordingly be free from moving parts, and the lamp cap can accordingly be manufactured in a comparatively simple and inexpensive manner.

The problem referred to as "black gap", known to those skilled in the art, may arise when the capped lamp is used as a vehicle lamp in a lighting unit. The black gap is visible as a dark ring around the luminous lamp vessel during operation of the lighting unit, which ring is surrounded by the light reflected by the reflector and originating from the electric element. The black gap is caused by light losses which occur when light originating from the electric element is incident on the lamp cap. The favorable situation in which the guidelines for counteracting the black gap problem in lighting units of vehicles are complied with is obtained in an embodiment which is characterized in that the lamp cap falls at least substantially completely within a cone having an apex in the center of the electric element and a half apex angle of at most 25°.

In a further preferred embodiment, the housing comprises a flat base portion which is at least substantially perpendicular to the axis. This base portion serves as an abutment for the placement of the lamp vessel in the lamp cap. The lamp vessel is closed in a gastight manner by means of a plate of insulating material which lies in a plane which is at least substantially perpendicular to the axis. In the manufacture of the lamp according to the invention, the electric element is mounted in a predetermined position relative to the plate of insulating material. The plate of the lamp vessel bears on the base portion of the lamp cap with a permanent compression force in the state in which the lamp vessel and the lamp cap are assembled together. The electric element thus occupies a predetermined position with respect to the reference location on the lamp cap. This embodiment of the lamp has a comparatively very small axial dimension. The housing in which the lamp is to be accommodated can be comparatively very flat thanks to this comparatively very small axial dimension.

A particularly favorable embodiment relates to a lamp wherein the lamp cap is provided with at least one decoupling means. The decoupling means is resiliently connected to the housing and together with the housing forms an at least substantially axial cylinder which surrounds the coupling means, which is preferably a resilient tag. This has the advantage that the lamp can be removed from its mounted state in a simple manner. The coupling means is in a hooked position in the mounted state. Pressing the decoupling means so far in the direction of the axis that it achieves a movement of the coupling means in the direction of the axis achieves that the coupling means leaves the hooked position, and the lamp is uncoupled and can be removed.

A further, particularly favorable embodiment relates to a lamp wherein the decoupling means is provided with a pressure stud. The relevant pressure stud has a comparatively small tangential dimension compared with a tangential dimension of a slot in hooking means of a support coupled to the lamp. This means that the pressure stud has comparatively much space, and the chance that the pressure stud will hook itself behind the hooking means while being pushed in the direction of the axis and during the removal of the lamp is comparatively small. Uncoupling of the lamp is facilitated thereby.

It is favorable to provide the lamp cap with pressure surfaces, preferably on the resilient intermediate portion, for further facilitating the handling of the lamp and bringing it into the mounted position. The contact members may be provided with screening means for avoiding direct contact between the contact members and the skin during handling of the capped lamp and/or for preventing pollution and/or damage by other causes. A more reliable operation of the contact is obtained thereby, for example in that the chance of contamination of the contact members, for example owing to inadvertent touching, is reduced.

In a further embodiment, the lamp cap is provided with an adapter. Various features may be provided on the adapter, for example standard contact points for electrical connection, whereby the assembly is further simplified, and/or, for example, a rubber ring. When the capped lamp and the adapter coupled thereto are coupled to a reflector, the adapter and the reflector will slide one over the other with narrow fit, with the ring in between, which is slightly compressed as a result and will close off the narrow passage in a gastight manner. It is counteracted thereby that volatile substances can enter the reflector through an opening between the lamp cap and the reflector. The ring is kept in position in this case, for example, in that it is present in a groove.

In another embodiment, the rubber ring is provided on the lamp cap, for example laid in a groove, so that a separate adapter is not necessary for closing off the narrow passage between the reflector and the lamp cap in a gastight manner. The penetration of volatile substances into the reflector through the narrow fit is thus counteracted in a comparatively simple manner. Alternatively, the reflector may be provided with the rubber ring instead of the lamp cap.

It is favorable when the lamp cap is constructed from synthetic resin at least for the major part. The resilient intermediate portion and the housing may then be made from the same material. It is possible in that case to give the lamp cap comparatively small dimensions because it itself is electrically insulating, which promotes safety. A wide variety of synthetic resins may be used in the lamp cap, for example thermoplastic synthetic resins, for example such materials filled with powder or with fibers, such as glass powder or glass fibers, for example polyether imide, polyether sulfon, polyether sulphide, polyphenylene sulphide, polybutylene terefthalate, etc., the latter synthetic resin being particularly suitable as a material for the housing of the lamp cap.

A further favorable embodiment is one in which the capped lamp is provided with a reflector, whereby the generated light can be focused and efficiently utilized. The use of the coupling means and the reference means of the lamp cap which cooperate with the reflector enable the reflector and the lamp cap, and accordingly the electric element, to be accurately positioned relative to one another.

The electric element of the electric lamp according to the invention may be, for example, an incandescent body, possibly in an inert gas comprising halogen. Alternatively, the element may be a pair of electrodes in an ionizable gas. In general, it will be favorable to position the electric element axially, in particular coaxially with the bulb.

The lamp cap of the electric lamp according to the invention has a universal construction which is suitable for front, back, and/or plate mounting in dependence on the support, for example adapter or plate, on which the lamp is mounted. The resilient intermediate portion and/or the housing of the lamp cap may be hollow, so that a saving can be made in lamp cap material and the lamp cap is lighter.

The electric lamp according to the invention is particularly suitable not only as a headlamp but also, for example, as a lamp at the rear of a vehicle, for example as a stop lamp, indicator lamp, tail light lamp, reversing lamp, fog rear lamp, etc.

BRIEF DESCRIPTION OF THE DRAWINGS

An embodiment of the electric lamp according to the invention is shown diagrammatically in the drawing, in which.

DETAILED DESCRIPTION OF THE INVENTION

Figure 1:
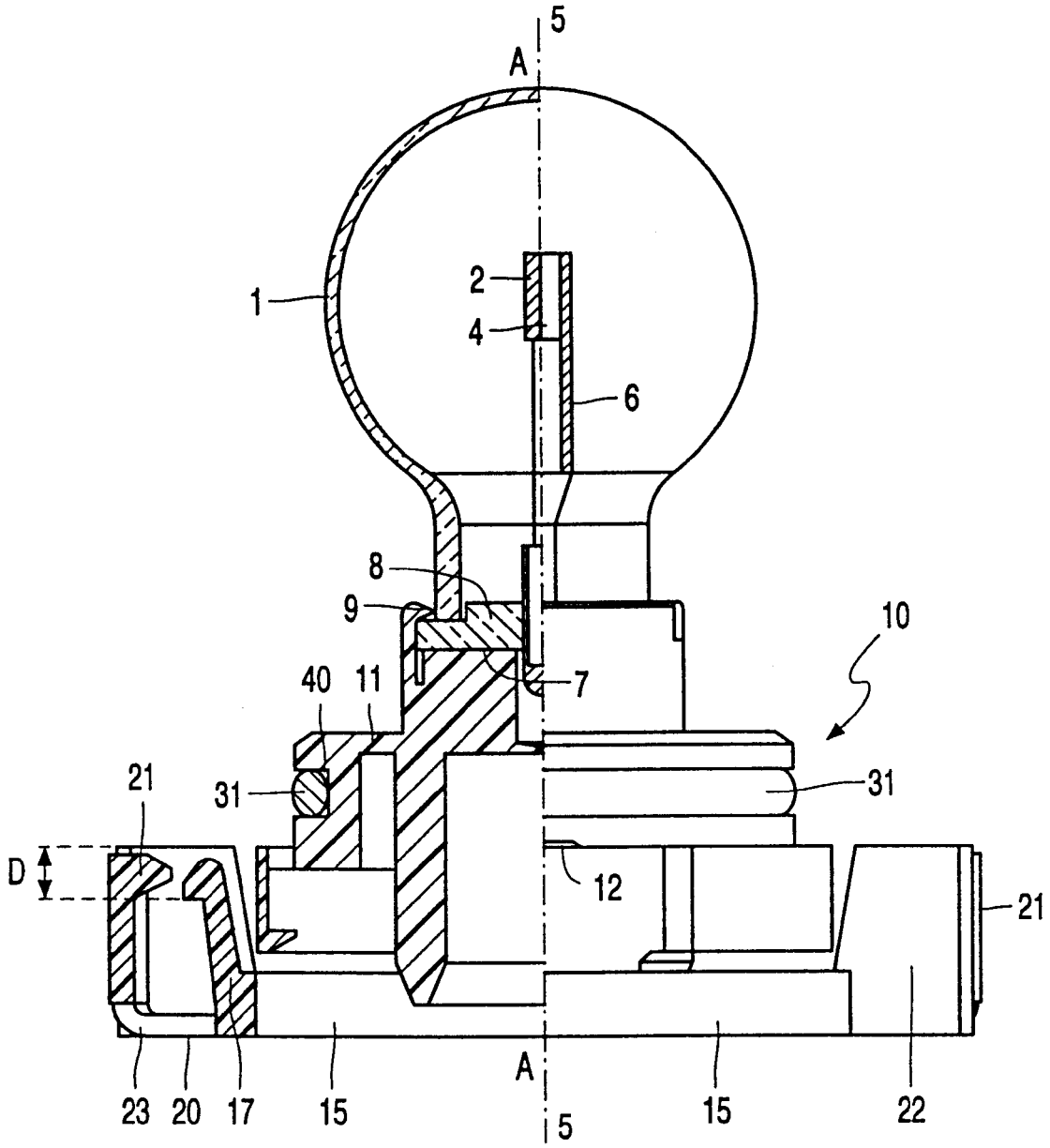
FIG. 1 shows a lamp with the lamp cap partly broken away along the line A—A in lateral view.

In FIG. 1, the electric lamp has a light-transmitting lamp vessel 1, for example made of glass, which is closed in a gastight manner and in which an electric element 2, a tungsten incandescent body with a center 4 in the Figure, is arranged axially on an axis 5 and is connected to current conductors 6 which issue from the lamp vessel to the exterior. The lamp shown has a filling of rare gas, for example an Ar/Ne mixture with a filling pressure of somewhat above 1 bar.

A lamp cap 10 is securely connected to the lamp vessel 1. The lamp cap has a synthetic resin housing 11. The housing 11 comprises a flat base portion 7 which is at least substantially perpendicular to the axis 5. The lamp vessel is closed in a gastight manner by means of a plate 8 of insulating material, which plate lies in a plane which is at least substantially perpendicular to the axis 5. In the manufacture of the lamp according to the invention, the electric element 2 is mounted in a predetermined position with respect to the plate 8. The plate of the lamp vessel is pressed home against the base portion by locking means 9, for example ridges, so that the electric element enters a predetermined position with respect to the reference means 12, for example surfaces. The surfaces 12 form part of the lamp cap and are designed to abut against a support 30, for example a reflector, as is visible in FIG. 2. A rubber ring 31 lying in a groove 40 is designed for realizing a gastight joint between the lamp and the support to be coupled thereto, for example an adapter or the reflector.

A resilient intermediate portion 15 which is provided with coupling means 17, resilient tags in the Figure, which are designed to couple the support to the lamp cap, forms an integral whole with the housing 11. The resilient action of the intermediate portion 15 is obtained in that the intermediate portion is made hollow. It was made hollow in such a manner that only a wall, forming the intermediate portion 15, and two bridges 19 remain (see FIG. 3). The wall has dimensions such that it is displaced in a substantially axial direction around the housing 11 in the case of an axial force. The resilient intermediate portion 15 is connected to the housing 11 via the two bridges 19 (see FIG. 3).

Tolerances in the axial distance D between the reference means and the coupling means can be accommodated because the reference means are present on the housing, the coupling means are present on the resilient intermediate portion, and the housing and the coupling means are resiliently interconnected.

The lamp is provided with decoupling means 21, each comprising a respective pressure stud 26 and a respective spring 23 by which they are connected to the resilient intermediate portion 15. The decoupling means are each surrounded in tangential direction by two protective walls 22. Pressure surfaces 20 which extend transversely to the axis are provided on the resilient intermediate portion 15 and are in at least substantially the same rotary positions around the axis as the decoupling means 21. A coupling means 17 is present each time between the housing 11 and the respective decoupling means 21 in radial direction. This has the advantage that the lamp can be removed from the mounted state in a simple manner. In the mounted state, the respective coupling means 17 is in a hooked state. Pressing the respective decoupling means 21 so far towards the axis 5 that the pressure stud 26 causes a movement of the coupling means in the direction of the axis causes the coupling means to leave the hooked state, so that the lamp is uncoupled and can be removed.

In a practical realization of the lamp in accordance with the described embodiment, the lamp has the advantage that it has a comparatively small axial dimension of approximately 5.5 cm and is nevertheless suitable for absorbing a comparatively high power of, for example, 5 to 25 W. The lamp has a life of approximately 6000 hours.

Figure 2:
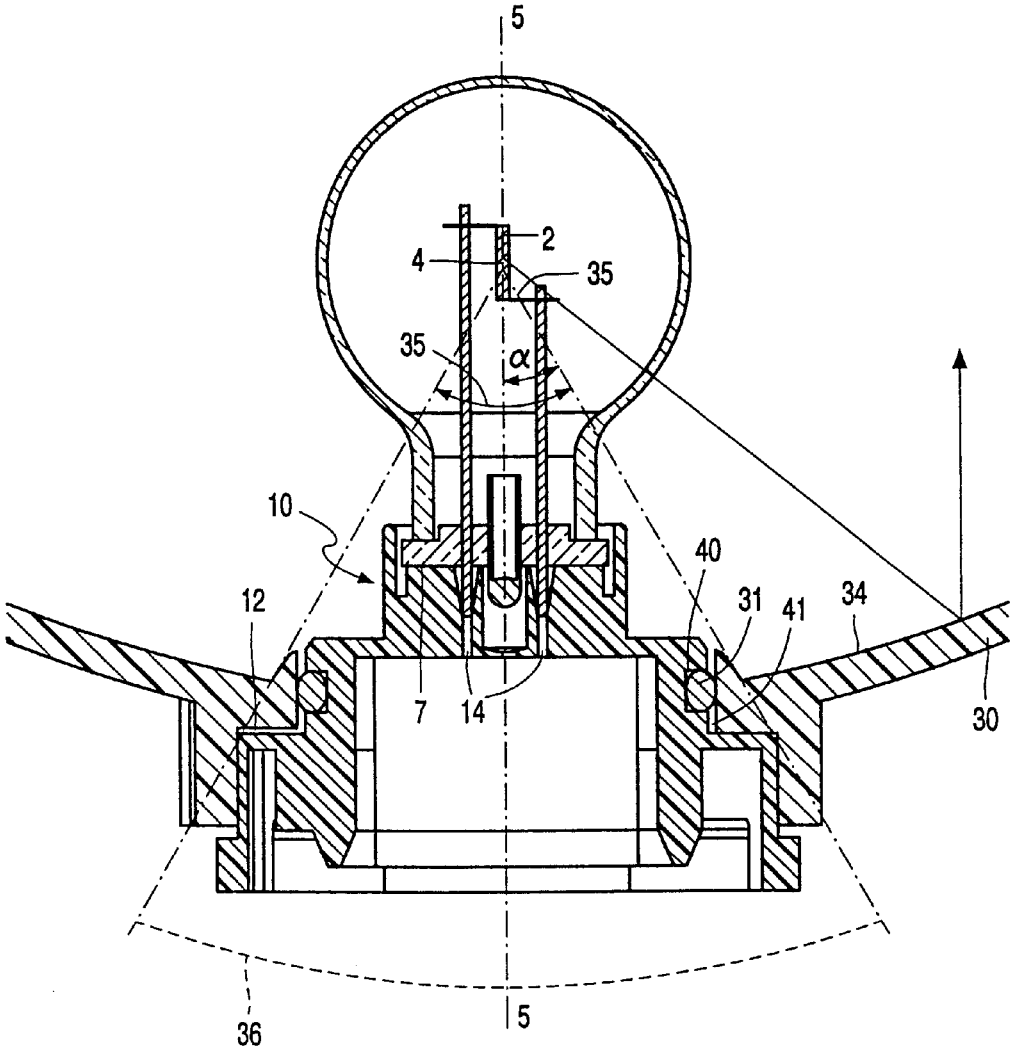
FIG. 2 shows a lamp coupled to a reflector.

FIG. 2 shows the lamp provided with a support 30, a reflector in the drawing. In this configuration of lamp and reflector 30, the rubber ring 31 lying in the groove 40 closes off the opening 41 between the lamp cap 10 and the reflector 30 in a gastight manner.

It is visible in the drawing that the lamp cap 10 falls substantially entirely within a cone 36 which has its apex 35 in the center 4 of the electric element 2 and has a half apex angle $\alpha$ of 25°. The light originating from the electric element 2 can reach the reflective surface 34 practically unhindered and is reflected there in an at least substantially axial direction. The surfaces 12 abut against the reflector, so that the electric element will enter a predetermined position with respect to the reflector.

Contact members 14 are provided in the flat base portion 7 in the Figure.

Figure 3:
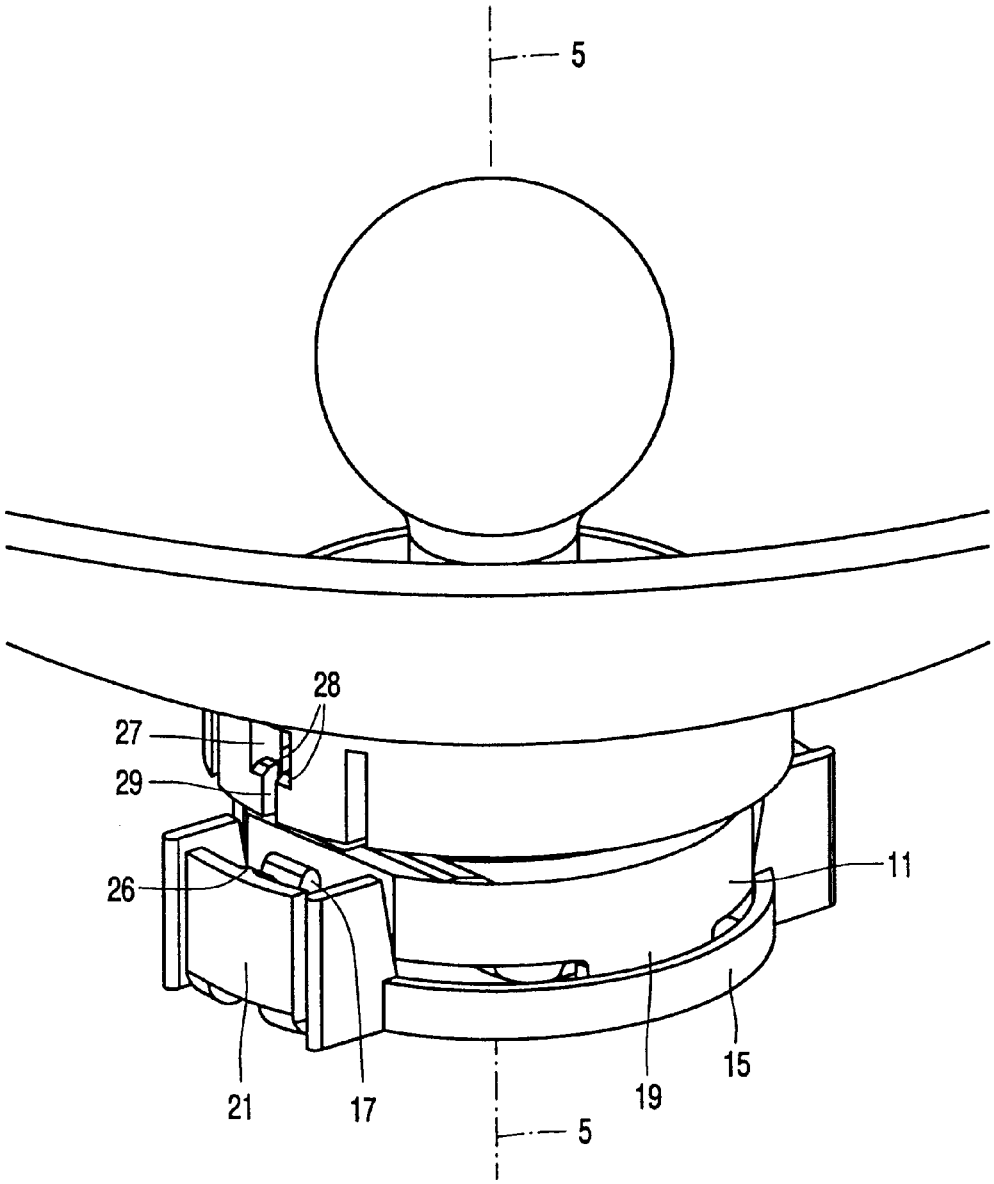
FIG. 3 is a perspective view of a capped lamp with reflector.

FIG. 3 shows in perspective view the capped lamp in a position relative to a reflector immediately after the moment of decoupling. During decoupling of the lamp and reflector, the respective decoupling means 21 were pressed so far in the direction of the axis 5 that the respective pressure studs 26 have caused a movement of the respective coupling means 17 in the direction of the axis, from a recess 27 in the reflector and from the hooked position behind hooking means 28 of the reflector. The respective pressure stud has a comparatively small tangential dimension compared with a tangential dimension of a slot 29 in the hooking means 28 of the reflector.

It is clearly visible that the resilient intermediate portion 15 has a dimension such that it undergoes a displacement in a substantially axial direction along the axis 5 around the housing 11 in the case of an axial force. The resilient intermediate portion 15 is connected to the housing 11 by means of two bridges 19.

What is claimed is:

1. A capped electric lamp provided with:

a light-transmitting lamp vessel which is closed in a gastight manner, which has an axis, and in which an electric element is arranged having a center and connected to current conductors which issue from the lamp vessel to the exterior;

a lamp cap connected to the lamp vessel, which lamp cap comprises a housing;

said housing being provided with:

contact members which are connected to the current conductors;

at least a reference means;

at least a locking means for locking the connection between the lamp vessel and the lamp cap; and at least a pair of coupling means, wherein the pair of coupling means forms an integral whole with the housing in that they share an integral, resilient intermediate portion located between the pair of coupling means.

2. A lamp as claimed in claim 1, wherein the resilient intermediate portion is displaceable around the housing in a substantially axial direction.

3. A capped electric lamp provided with:

a light-transmitting lamp vessel which is closed in a gastight manner, which has an axis, and in which an electric element is arranged having a center and connected to current conductors which issue from the lamp vessel to the exterior;

a lamp cap connected to the lamp vessel, which lamp cap comprises a housing;

said housing being provided with:

contact members which are connected to the current conductors;

at least a reference means;

at least a locking means for locking the connection between the lamp vessel and the lamp cap; and at least a coupling means, wherein the coupling means forms an integral whole with the housing in that they share an integral, resilient intermediate portion, and wherein the lamp cap falls at least substantially completely within a cone having an apex in the center of the electric element and a half apex angle of at most 25°.

4. A lamp as claimed in claim 1, wherein the housing comprises a flat base portion which is at least substantially perpendicular to the axis.

5. A lamp as claimed in claim 1, wherein the lamp cap is provided with at least one decoupling means.

6. A lamp as claimed in claim 5, wherein the decoupling means (21) is provided with a pressure stud.

7. A lamp as claimed in claim 1, wherein the lamp cap is provided with at least one pressure surface.

8. A lamp as claimed in claim 1, wherein the lamp cap is provided with an adapter.

9. A lamp as claimed in claim 1, wherein the lamp cap is provided with a rubber ring.

10. A lamp as claimed in claim 1, wherein the lamp cap is constructed from synthetic resin at least for the major part.

11. A lamp as claimed in claim 1, wherein the lamp is provided with a reflector.

12. A lamp comprising:

a vessel which is closed in a gastight manner;

an electric element located in the vessel and connected to current conductors which exit the vessel; and a cap connected to the lamp vessel, wherein the cap falls at least substantially completely within a cone having an apex in the center of the electric element and a half apex angle of at most 25°.

13. A lamp as claimed in claim 12, wherein said cap has a housing;

said housing comprising:

contact members which are connected to the current conductors;

at least a reference means;

at least a locking means for locking the vessel and the cap; and at least a coupling means, wherein the coupling means forms an integral whole with the housing, the coupling means and the housing sharing an integral, resilient intermediate portion.

14. A lamp as claimed in claim 13, wherein the resilient intermediate portion is displaceable around the housing in a substantially axial direction.

15. A lamp as claimed in claim 12, wherein the housing comprises a flat base portion which is at least substantially perpendicular to an axis of the vessel.

16. A lamp as claimed in claim 12, wherein the cap is provided with at least one decoupling means.

17. A lamp as claimed in claim 16, wherein the decoupling means is provided with a pressure stud.

18. A lamp as claimed in claim 12, wherein the cap is provided with at least one pressure surface.

19. A lamp as claimed in claim 12, wherein the cap is provided with an adapter.

20. A lamp as claimed in claim 12, wherein the cap is provided with a rubber ring.

21. A lamp as claimed in claim 12, wherein the cap is constructed from synthetic resin.

22. A lamp as claimed in claim 12, wherein the lamp is provided with a reflector.

23. A lamp comprising:

a vessel which is closed in a gastight manner;

an electric element located in the vessel and connected to current conductors which exit the vessel; and a cap connected to the lamp vessel and having a pair of couplers which are interconnected by a resilient intermediate portion of the cap.

24. A lamp as claimed in claim 23, wherein said resilient intermediate portion is integral with the cap.

25. A lamp as claimed in claim 23, wherein said cap includes a housing and said resilient intermediate portion is connected to the housing.

26. A lamp as claimed in claim 25, wherein resilient intermediate portion is connected to the housing via two bridges.

27. A lamp as claimed in claim 23, wherein said cap includes a housing and said resilient intermediate portion is connected to the housing via at least one bridge.

28. A lamp as claimed in claim 23, wherein an internal dimension of said resilient intermediate portion is greater than an external dimension of said housing so that said resilient intermediate portion surrounds said housing.

* * * * *